US005775312A

United States Patent [19]

Wilkinson et al.

[11] Patent Number: 5,775,312

[45] Date of Patent: Jul. 7, 1998

[54] SPRING AIR GUN WITH INTERLOCKING MECHANISM

[75] Inventors: Todd D. Wilkinson, West Henrietta; Kenton H. Barker, Penfield, both of N.Y.; James Grassi, Princeton, N.J.

[73] Assignee: Crosman Corporation, East Bloomfield, N.Y.

[21] Appl. No.: 798,043

[22] Filed: Feb. 10, 1997

[51] Int. Cl.[6] ..... F41B 11/14

[52] U.S. Cl. ..... 124/67

[58] Field of Search ..... 124/66, 67

[56] References Cited

U.S. PATENT DOCUMENTS

| | | | |
|---|---|---|---|
| 3,090,151 | 5/1963 | Stewart et al. | 124/67 X |
| 4,289,109 | 9/1981 | D'Andrade et al. | 124/67 |
| 4,367,723 | 1/1983 | Resuggan | 124/67 |
| 5,160,795 | 11/1992 | Milliman | 42/65 |
| 5,165,383 | 11/1992 | Ebert et al. | 124/74 |

FOREIGN PATENT DOCUMENTS

| | | | |
|---|---|---|---|
| 754659 | 11/1933 | France | 124/66 |

OTHER PUBLICATIONS

Marksman Owner's Manual for Models 1010, 1010H, 1010X, 1015, 1300 BB Repeater Air Pistol, Jul. 1992.

*Primary Examiner*—John A. Ricci

[57] ABSTRACT

A spring air gun includes a reciprocable piston and a slide for cocking the piston. The slide is movable between forward and rearward positions. A piston rod is connected to the slide and is slidably mounted within a piston tube which is connected to the piston. A pair of springs are concentrically mounted on the piston tube, and the forward end of each spring engages the piston. The rearward end of the inner spring engages the slide, and the rearward end of the outer spring engages the frame of the gun. A detent maintains the slide in the forward position, and a sear maintains the piston in the cocked position and is engageable with the detent for preventing the slide from moving rearwardly until the gun is fired. The gun is fired by pulling a trigger, which releases the sear from the piston. The detent can then be moved to allow the slide to be moved rearwardly to cock the piston. When the slide is not in the forward position, the detent prevents the trigger from being pulled.

23 Claims, 14 Drawing Sheets

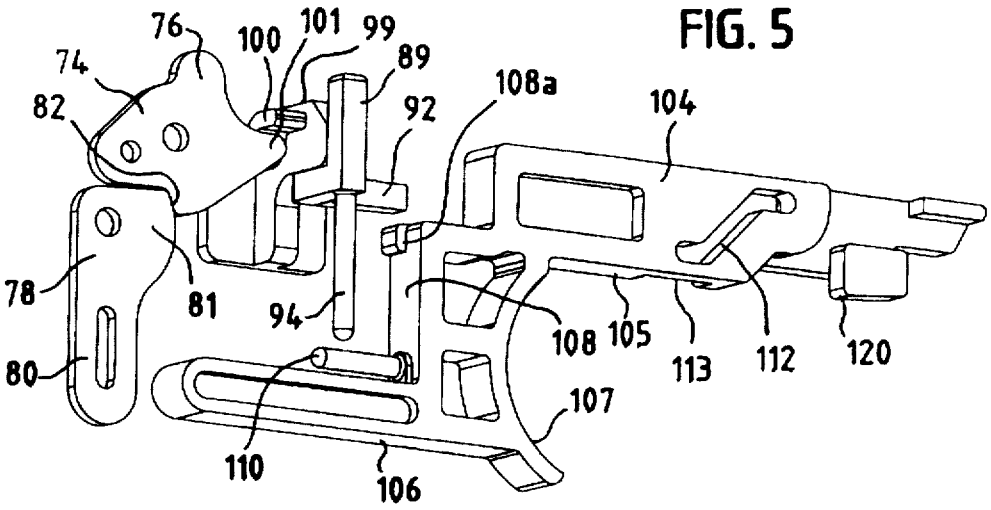
FIG. 5
FIG. 10
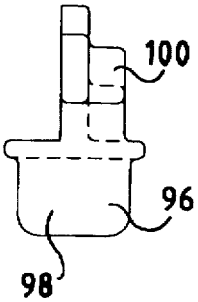
FIG. 6
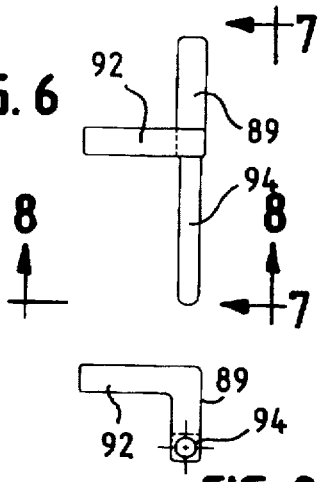
FIG. 8
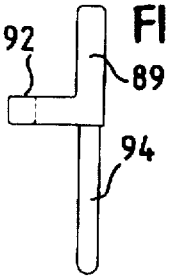
FIG. 7
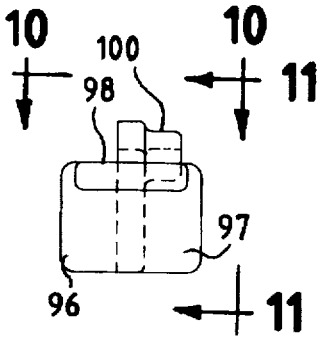
FIG. 9
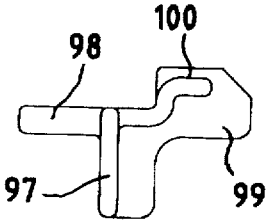
FIG. 11

FIG. 12
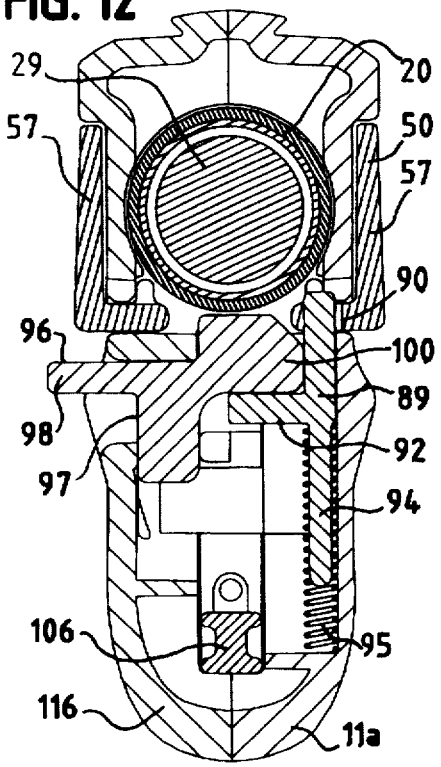
FIG. 13
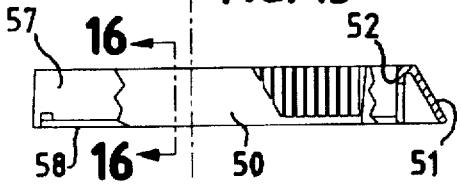
FIG. 14
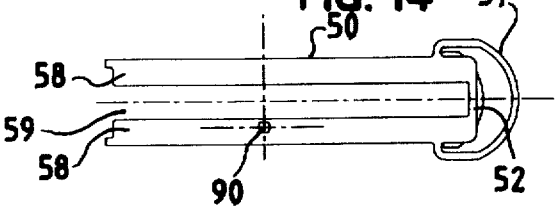
FIG. 15
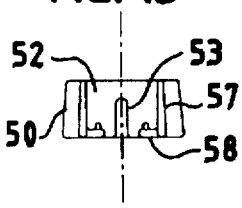
FIG. 16
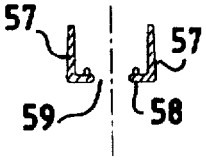
FIG. 17
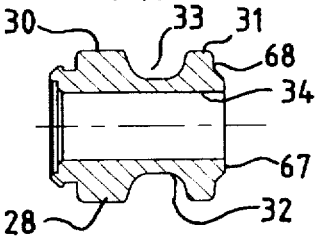
FIG. 18
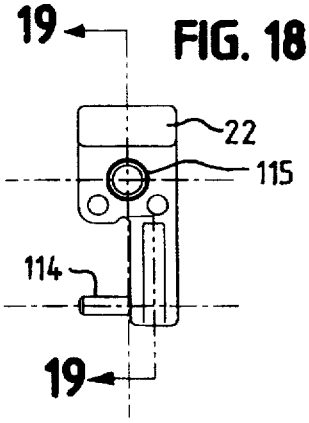
FIG. 19
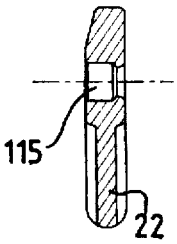
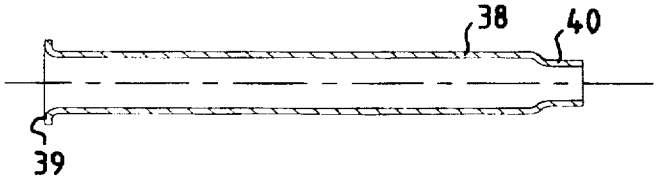
FIG. 20
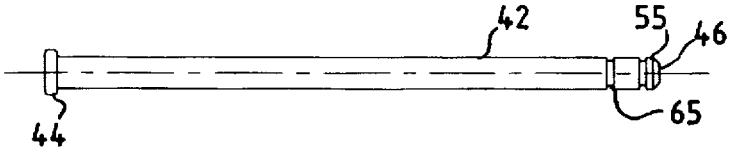
FIG. 21

FIG. 23
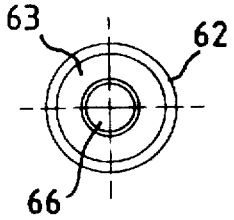
FIG. 22
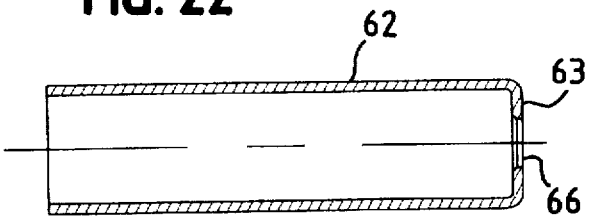
FIG. 25
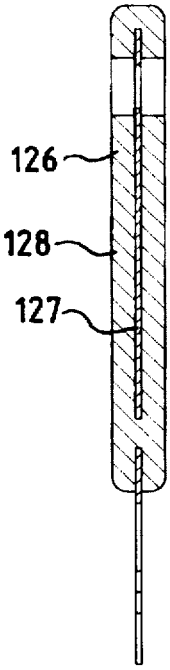
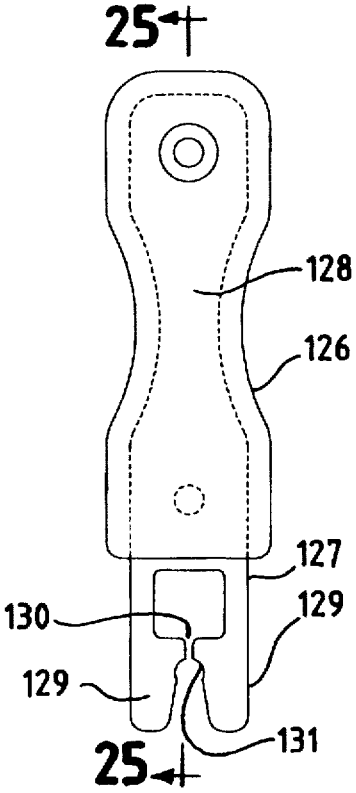
FIG. 24
FIG. 26
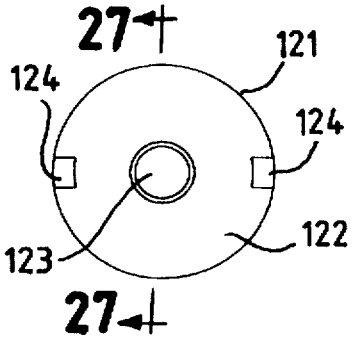
FIG. 27
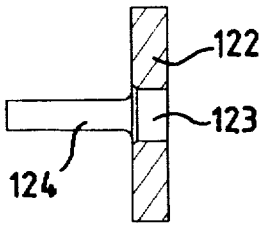

SPRING AIR GUN WITH INTERLOCKING MECHANISM

BACKGROUND

This invention relates to spring air guns, and, more particularly, to a spring air gun with an interlocking mechanism for preventing movement of the cocking slide when the gun is cocked and for preventing movement of the trigger when the cocking slide is not in its firing position.

Spring air guns conventionally include a compression cylinder and a piston which is reciprocable within the compression cylinder for compressing air within the cylinder. The compressed air flows into the barrel of the gun at high velocity for propelling a projectile out of the barrel. The piston is driven by a main compression spring, and the piston is maintained in a cocked position by a sear. The sear is released from engagement with the piston when the trigger is pulled.

Certain types of spring air guns are cocked by a slide which pulls the piston rearwardly or away from the barrel to compress the main spring. A detent is engageable with the slide and must be released before the slide can be pulled rearwardly. When the detent is released, a second spring which is concentrically mounted within the main spring propels the slide rearwardly for a short distance. The sear prevents the detent from being released until the gun is fired to prevent the slide from being propelled rearwardly by the inner spring.

SUMMARY OF THE INVENTION

The invention provides a slide-cocking spring air gun with an interlocking mechanism which not only prevents the slide from being released from its cocked position unless the gun is fired but also prevents the trigger from being pulled unless the slide is in the cocked position. If the gun were fired when the slide is in its rearward or uncocked position, the slide would be propelled forwardly under the force of the main spring and possibly cause injury to the operator. When the slide returns to the forward, cocked position, the interlocking mechanism disengages the trigger and allows the gun to be fired. The invention also provides tools and a method for safely assembling and removing the springs of the gun.

DESCRIPTION OF THE DRAWING

The invention will be explained in conjunction with an illustrative embodiment shown in the accompanying drawings, in which

FIG. 5 is a perspective view of some of the parts of the interlocking mechanism;

FIG. 6 is an elevational view of the detent;

FIG. 7 is a view of the detent taken along the line 7—7 of FIG. 6;

FIG. 8 is a bottom view of the detent taken along the line 8—8 of FIG. 6;

FIG. 9 is an elevational view of the detent lever;

FIG. 10 is a top view of the detent lever taken along the line 10—10 of FIG. 9;

FIG. 11 is a side view of the detent lever taken along the line 11—11 of FIG. 9;

FIG. 12 is a sectional view taken along the line 12—12 of FIG. 4;

FIG. 13 is a side view, partially broken away, of the slide;

FIG. 14 is a bottom view of the slide;

FIG. 15 is a front end view of the slide;

FIG. 16 is a sectional view taken along the line 16—16 of FIG. 15;

FIG. 17 is a sectional view of the piston;

FIG. 18 is a front view of the loader;

FIG. 19 is a sectional view taken along the line 19—19 of FIG. 18;

FIG. 20 is a sectional view of the piston tube;

FIG. 21 is a side view of the piston rod;

FIG. 22 is a sectional view of the piston sleeve;

FIG. 23 is a front end view of the piston sleeve;

FIG. 24 is an elevational view of the tool for inserting the main spring;

FIG. 25 is a sectional view taken along the line 25—25 of FIG. 24;

FIG. 26 is an end view of the bushing for inserting the main spring;

FIG. 27 is a sectional view taken along the line 27—27 of FIG. 26;

DESCRIPTION OF SPECIFIC EMBODIMENT

Figure 1:
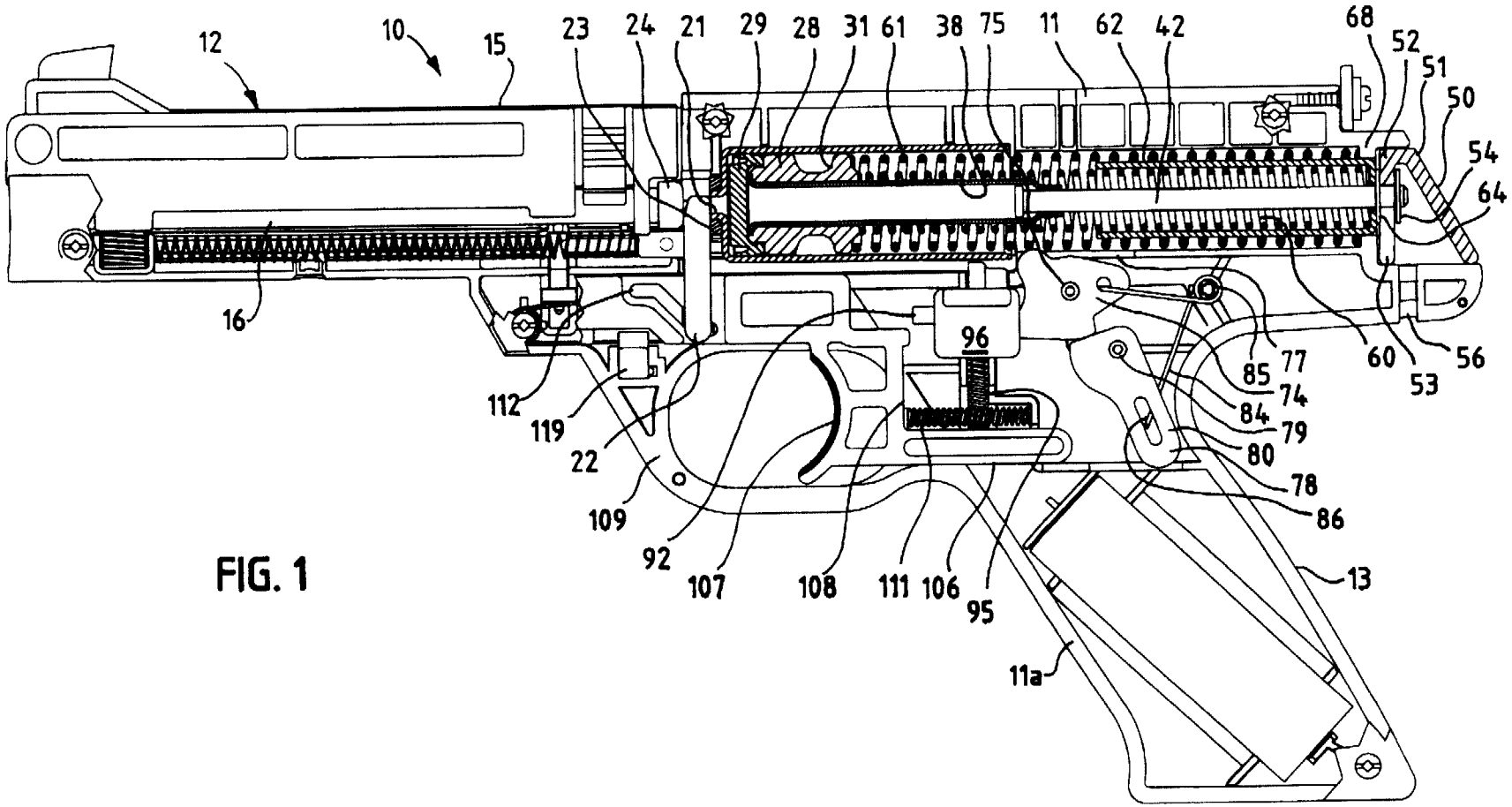
FIG. 1 is a fragmentary side sectional view of a spring air gun which is provided with the inventive interlocking mechanism, the gun being shown in the fired position.

Referring to FIGS. 1–4, a spring air gun 10 includes a frame or receiver 11, a barrel assembly 12, and a grip 13. The frame includes left and right frame halves 11*a* and 11*b* (FIGS. 12 and 29) which are bolted together. The particular barrel assembly illustrated is pivotally mounted on the frame and includes a housing 15 and a metal tubular barrel insert 16.

A compression cylinder 20 is mounted within the frame and includes a nipple 21 which provides a small diameter outlet orifice. A loader 22 (see also FIGS. 18 and 19) is slidably mounted in front of the nipple for moving a projectile into alignment with the outlet orifice and the bore of the barrel insert. Gaskets or seals 23 and 24 on the nipple 21 and the barrel insert 16 sealingly engage the loader when the gun is fired.

A piston 28 is reciprocably mounted in the compression cylinder 20. A gasket or seal 29 is carried by the forward end of the piston and sealingly engages the inside surface of the cylinder. The piston is somewhat spool-shaped and includes a pair of annular rim portions 30 and 31 (FIG. 17) which are connected by reduced-diameter central portion 32 which provides an annular recess 33 between the rim portions. A bore 34 extends axially through the piston.

A hollow piston tube 38 (see also FIG. 20) extends through the bore of the piston. The front end of the piston tube includes an outwardly extending flange which engages the front end of the piston, and the rear end of the piston tube includes a necked-down end portion 40.

A piston rod 42 (see also FIG. 21) is slidably received within the necked-down end portion 40 of the piston tube. The forward end of the piston rod includes a radially enlarged flange 44 which is engageable with the small diameter end portion 40 to prevent the piston rod from being withdrawn from the end portion 40.

The rear end 46 of the piston rod 42 is attached to a slide 50 (see also FIGS. 12–16) which is slidably mounted on the frame for sliding movement in the direction of the axis of the compression cylinder 20. The rear end of the slide includes an angled end wall 51 and a transverse rear 52 having a slot 53 wall through which the rear end 46 of the piston rod extends. The piston rod is secured to the slide by a locking ring 54 (FIG. 1) which is inserted into an annular groove 55 (FIG. 21) in the piston rod. A slot 56 (FIG. 1) in the receiver below the transverse wall 52 provides access for inserting the locking ring. The slide 50 includes a pair of longitudinally extending side walls 57 which extend along the outside of the frame and a pair of bottom walls 58 which extend laterally inwardly into longitudinal grooves in the frame. The bottom walls are separated by a central slot 59.

A pair of concentric springs 60 and 61 (FIG. 1) surround the piston tube 38, and the rear ends of the springs are separated by a cylindrical spring sleeve 62 (see also FIGS. 22 and 23). The spring sleeve includes a rear wall 63 which butts against a locking ring 64 which is inserted into an annular groove 65 (FIG. 21) in the piston rod. The piston rod 42 extends through an opening 66 in the rear wall 63. The small diameter inner spring 60 is compressed between a shoulder 67 (FIG. 17) on the piston 28 and the rear wall 63 of the spring sleeve. The large diameter outer spring 61 is compressed between a shoulder 68 (FIG. 17) on the piston and a radially extending flange 68 (FIG. 1) on the frame. The spring sleeve 62 and the inner spring 60 extend through an opening provided through the flange 68.

A sear 74 is rotatably mounted on the frame by a pin 75. The sear includes a projection 76 (FIG. 5) which can extend through the slot 59 between the bottom walls 58 of the slide 50, through a slot 77 (FIG. 1) in the receiver halves, and into the recess 33 of the piston to engage the rear rim 31 of the piston to maintain the piston in the cocked position illustrated in FIGS. 3 and 4.

The sear is maintained in the cocked position by a cam 78 which is rotatably mounted on the frame by a pin 79. Referring to FIG. 5, the cam includes a lever arm 80 and a projection 81 which engages a shoulder 82 on the sear to prevent the sear from rotating counterclockwise under the force of the springs 60 and 62.

A spring 84 (FIG. 3) is wrapped around a pin 85 on the frame. One leg 86 of the spring engages the lever arm 80 to urge the lever arm to rotate clockwise. Another leg 87 of the spring extends through an opening in the sear and urges the sear to rotate clockwise when the sear is cocked.

Figure 4:
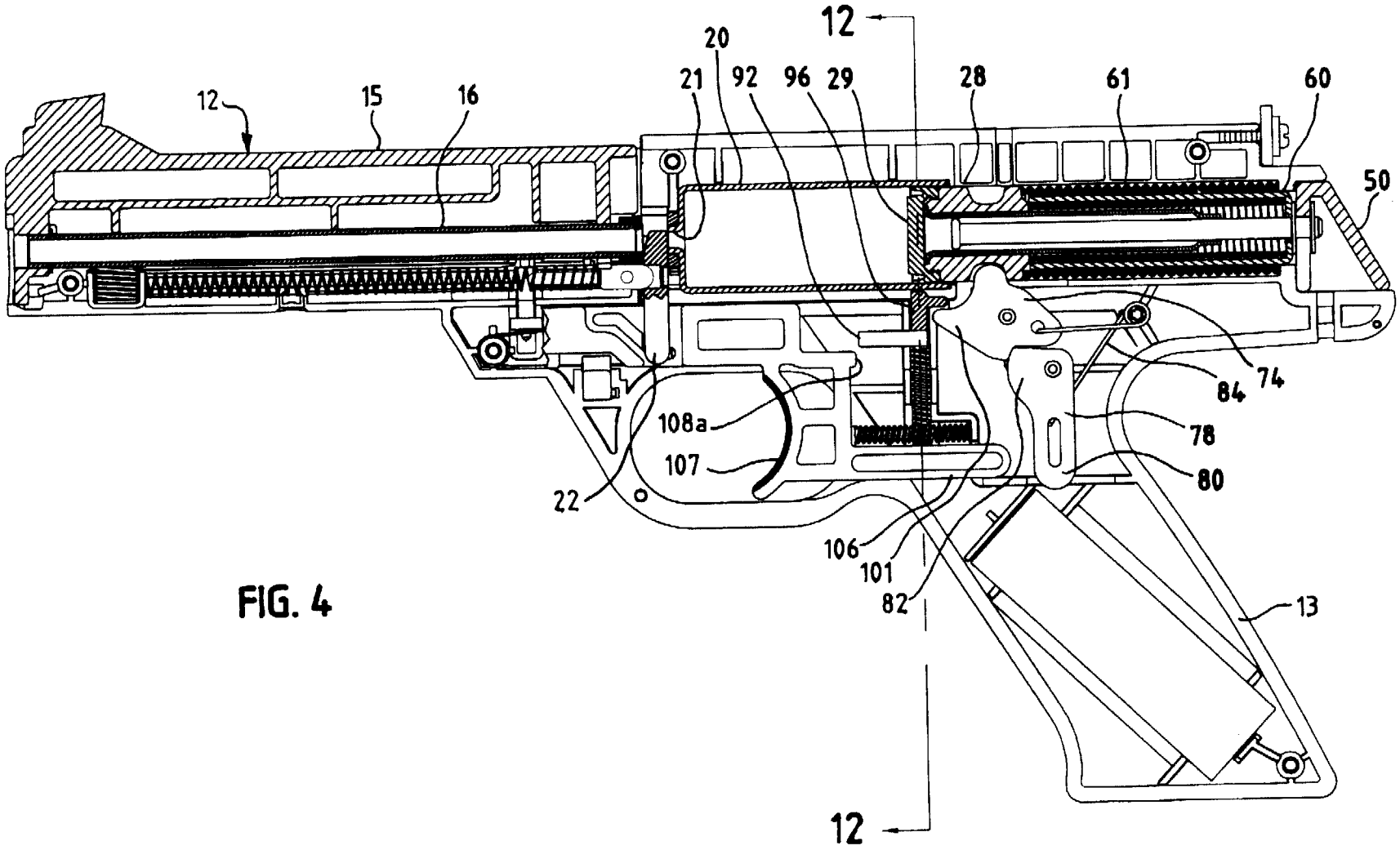
FIG. 4 is a view similar to FIGS. 1–3 showing the gun in the cocked and ready to fire position.

A detent 89 (see also FIGS. 5–8 and 12) is slidably mounted on the frame for movement perpendicular to the axis of the compression cylinder 20. In FIGS. 4 and 12 the detent extends upwardly through an opening 90 (see also FIG. 14) in the bottom wall 58 of the slide and prevents the slide from moving rearwardly under the force of the small diameter spring 60. The detent includes an L-shaped laterally and forwardly extending arm 92 and a downwardly extending leg 94 on which is mounted a detent spring 95 (FIG. 12).

A detent lever 96 (see also FIGS. 5 and 9–12) is slidably mounted on the frame for engagement with the arm 92 of the detent. The detent lever includes a slide portion 97 which slidably engages the inside wall of the left frame half 11*a*, a push button 98 which extends laterally outwardly through a slot in the left frame half, a first laterally inwardly extending shoulder 99, and a second laterally inwardly extending shoulder 100. The shoulder 99 extends above the arm 92 of the detent, and the shoulder 100 is engageable with a projection 101 (FIG. 5) on the sear when the sear is cocked.

A trigger 104 is slidably mounted on the frame and includes a front slide portion 105 (FIG. 5), a rear projection 106, a finger portion 107, and a stop shoulder 108 having a projection 108*a*. As can be seen in FIG. 1 the front slide portion is slidably supported by a flat wall on the frame, and the finger portion extends into the opening of a trigger guard 109 on the frame. The rear projection 106 is also slidably supported by the frame. A rod 110 (FIG. 5) extends rearwardly from the finger portion above the rear projection, and a trigger spring 111 (FIG. 1) is mounted on the rod.

A generally Z-shaped camming slot 112 extends through a recessed portion 113 in the front slide portion 105 of the trigger for reciprocating the loader 22. As described in U.S. Pat. No. 5,165,383, the loader includes a pin 114 (FIG. 18) which extends into the slot 112 and an opening 115 for holding a projectile such as a BB or a pellet. When the trigger is in the unfired position illustrated in FIGS. 1–4, the projectile is positioned below the barrel 16 and the outlet orifice of the compression cylinder 20. When the trigger is pulled rearwardly, the loader is cammed upwardly by the slot 112 to position the projectile in alignment with the barrel and the outlet orifice before the sear is released.

BB's or pellets are fed to the loader by a BB pusher 116 (FIG. 2) which is slidably mounted in a BB magazine 117 and which is biased toward the loader by a spring 118.

A safety 119 (FIG. 1) on the frame can be moved behind a projection 120 (FIG. 5) on the front slide portion 105 of the trigger to prevent the trigger from being pulled.

FIG. 1 illustrates the gun after the gun has been fired. The piston 38 is in the forward portion of the compression cylinder 20. The necked-down rear end portion 40 of the piston tube 38 is a short distance behind the flange 44 on the front end of the piston rod 42. The detent 89 extends into the opening 90 in the bottom of the slide and locks the slide against rearward movement.

The gun cannot be cocked until the detent lever 96 is pushed downwardly to withdraw the detent 89 from the opening 90 in the slide 50. Since the sear has been rotated into the fired position, the projection 101 on the sear does not engage the shoulder 100 on the detent lever and does not prevent depressing the detent lever.

Figure 2:
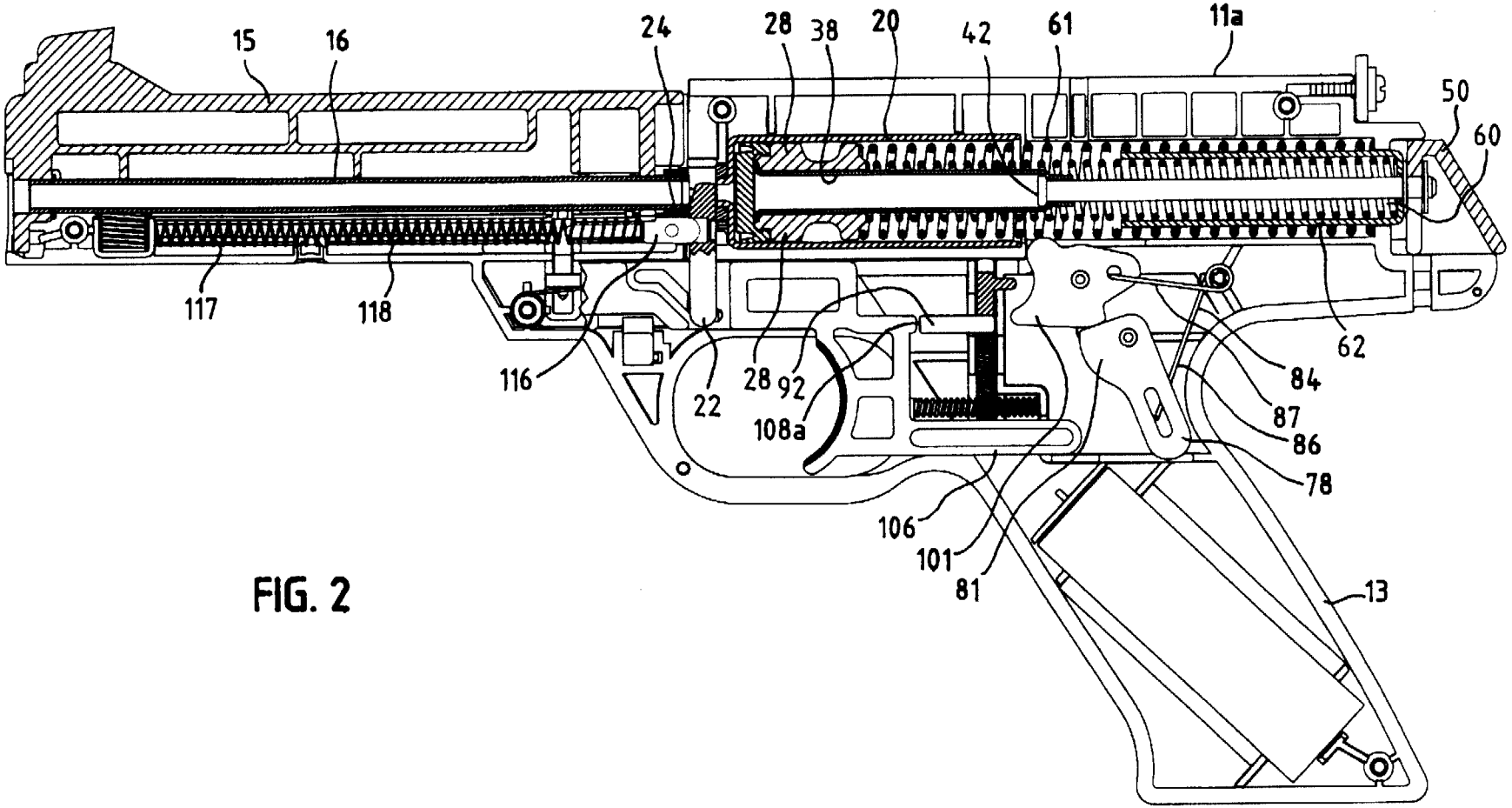
FIG. 2 is a view similar to FIG. 1 showing the slide in a released position.

FIG. 2 illustrates the gun after the detent lever 96 has been pushed downwardly to withdraw the detent 89 from the opening 90 in the slide. The detent lever 96 is sectioned in FIG. 2 to illustrate the lower position of the detent arm 92.

When the detent is withdrawn from the slide 50, the small diameter spring 60 propels the slide rearwardly a short distance until the flange 44 on the piston rod engages the necked-down end 40 of the piston tube. The operator then cocks the large spring by pulling the slide rearwardly (FIG. 3) until the recess 33 in the piston moves over the sear. The spring 84 rotates the sear clockwise into engagement with the rim 31 of the piston and rotates the cam 78 clockwise so that the projection 81 locks the sear in the cocked position.

Figure 3:
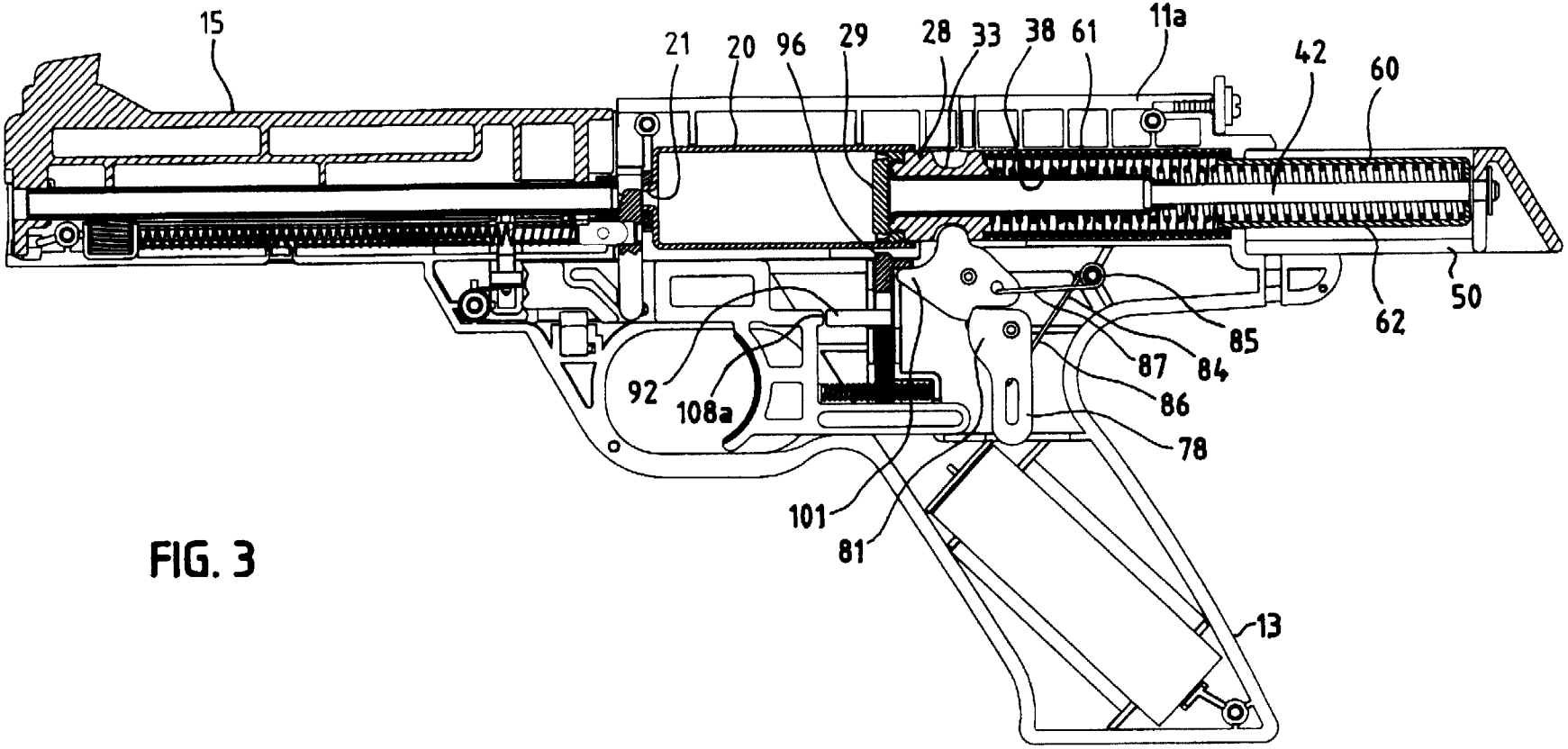
FIG. 3 is a view similar to FIGS. 1 and 2 showing the slide in the rearward position.

When the slide 50 is in its rear position illustrated in FIG. 3, the detent 89 is held depressed by the bottom wall 58 of the slide so that the arm 92 on the detent is engageable with the stop projection 108*a* of the trigger. The trigger is thereby prevented from being pulled until the slide returns to its forward position. If the trigger could be pulled while the slide was in the rear position, the slide would accelerate forwardly under the force of the large diameter spring 61 and could possibly cause injury to the operator.

When the slide is moved to its rear position and the sear rotates into engagement with the piston (FIG. 3), the projection 101 on the sear moves into position below the shoulder 100 on the detent lever 96 and locks the detent lever in the raised position. The detent lever cannot be depressed until after the gun has been fired.

When the slide 50 is returned to its forward position illustrated in FIG. 4, the small diameter spring 60 is compressed and the detent 89 is forced by the detent spring 95 to move upwardly into the opening 90 in the bottom wall 51 of the slide to lock the slide. The detent arm 92 moves above the stop projection 108*a* of the trigger, allowing the trigger to be pulled.

The gun is in the cocked, ready-to-fire position in FIG. 4. Both the large diameter main spring 61 and the small diameter spring 60 are compressed behind the piston 28. The piston is prevented from moving forwardly by the sear 74. The slide 50 is prevented from moving rearwardly by the detent 89 which extends upwardly through the opening 90 in the slide bottom wall 58 (FIG. 14). The detent lever 96 is prevented from moving downwardly by the projection 101 on the sear which is engageable with the shoulder 100 on the detent lever. The arm 92 on the detent is above the stop projection 108*a* on the trigger so that the detent does not prevent the trigger from being pulled.

When the trigger is pulled rearwardly, the rear projection 106 pushes the lever arm 80 of the cam 78 to rotate the cam counterclockwise out of engagement with the shoulder 82 of the sear. The sear is thereby freed to rotate counterclockwise under the force of the compressed springs 60 and 62, and the piston is driven forwardly within the compression cylinder 20 by the springs. The piston rapidly compresses the air within the compression cylinder, and the compressed air flows at high velocity through the outlet nipple 21 to drive the projectile from the loader 22 and through the barrel.

The detent lever 96 is locked in its raised position by the sear, and the detent lever cannot be lowered to withdraw the detent 89 from the slide until after the gun is fired. If the slide could be released before the gun is fired, the slide would accelerate rearwardly under the force of the small diameter spring 60 and possibly cause injury to the operator.

Figure 29:
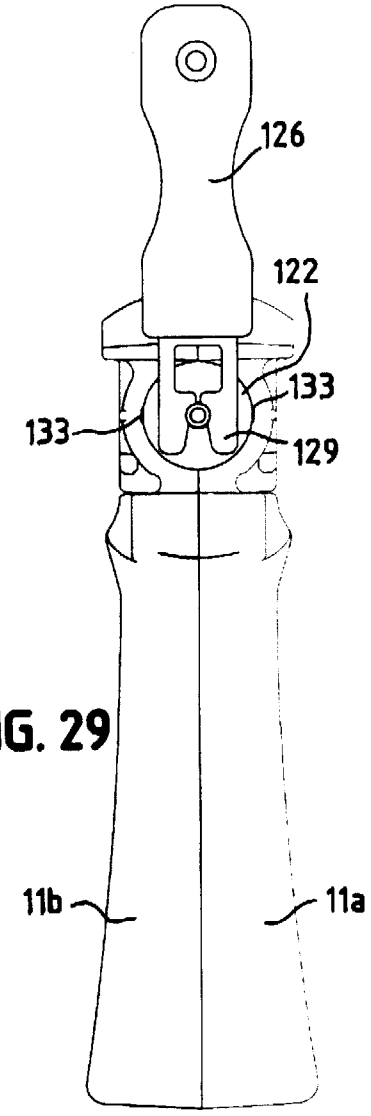
FIG. 29 is an end view showing the method of inserting the main spring.
Figure 28:
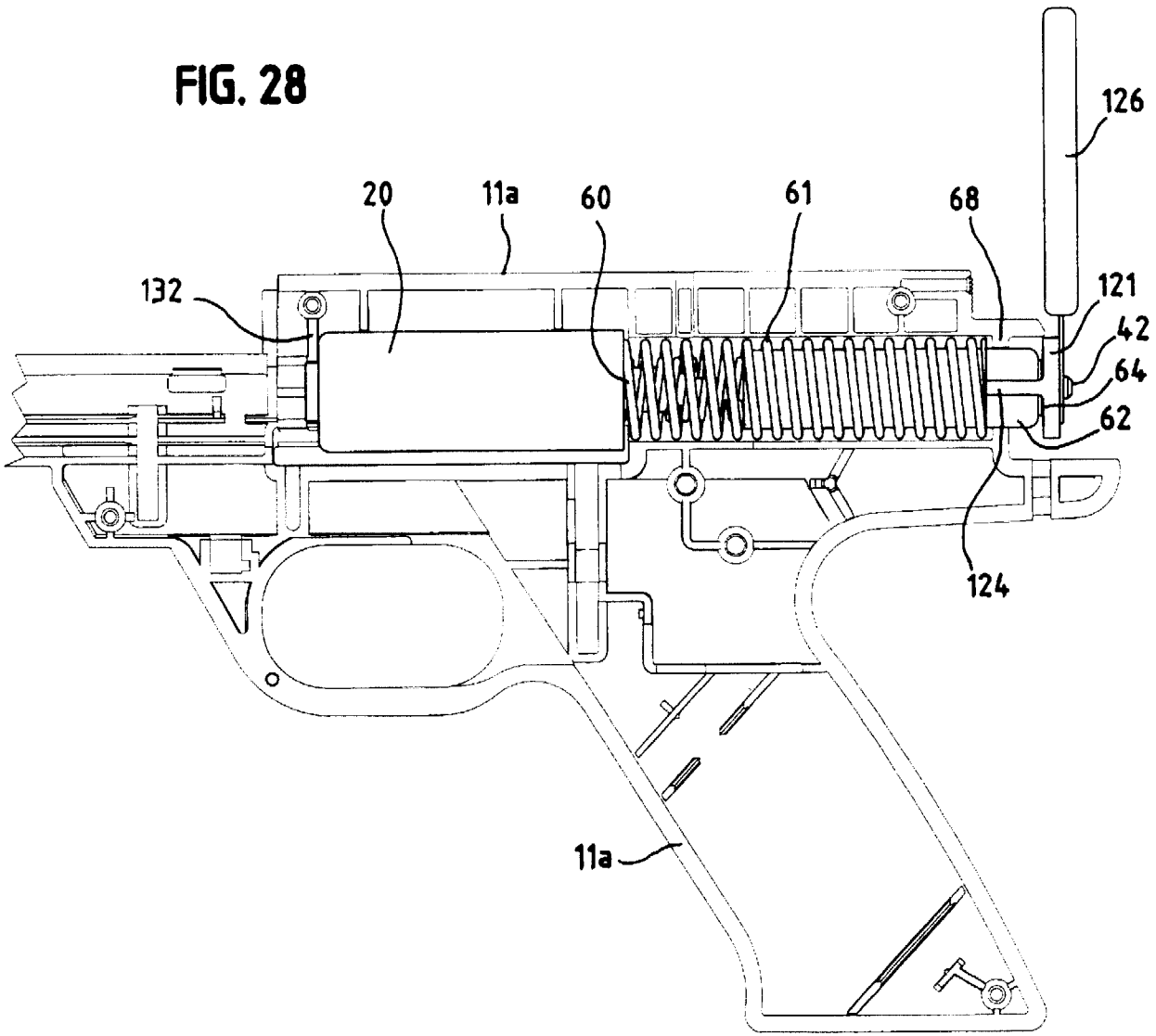
FIG. 28 is a fragmentary view of the right half of the receiver showing the method of inserting the main spring.

FIGS. 28 and 29 illustrate the method and tools which are used to assemble and disassemble the inner and outer springs 60 and 61. The piston rod 42 is inserted into the piston tube 38, and the piston tube can be conveniently held by inserting the piston tube over a mandrel which has an outside diameter of approximately the same as the inside diameter of the piston tube. The piston 28 is then inserted over the piston rod 42 and the piston tube 38 until the piston abuts against the flange 39 on the front end of the piston tube. The inner spring 60 is then inserted over the piston rod and the piston tube, the spring sleeve 62 is inserted over the inner spring 60, and the piston sleeve is pushed toward the piston to compress the inner spring until the rear end of the piston rod 42 extends through the opening 66 in the spring sleeve. The locking ring 64 is inserted on the end of the piston rod to prevent the rod from being withdrawn through the opening 66 in the spring sleeve.

The outer spring 61 is then inserted over the spring sleeve 62 until it butts against the piston 28. The rear end of the outer spring 61 is then compressed forwardly beyond the rear end of the spring sleeve by a bushing 121 (FIGS. 26 and 27) as shown in FIG. 28. The bushing includes a disc 122 having an opening 123 for the piston rod 42 and a pair of legs 124. The bushing is pushed over the end of the piston rod 42 until the disc abuts the locking ring 64. The legs 124 extend alongside the spring sleeve 62 and compress the outer spring 61. A locking tool 126 is inserted onto the spring rod to retain the bushing 121 on the spring rod. The locking tool includes a metal plate 127 (FIGS. 24 and 25) and a handle 128 which is molded around the plate. The plate includes a pair of resilient prongs 129 which are separated by a slit 130. Each prong includes an arcuate recess 131 so that the prongs can be inserted into the locking groove 55 (FIG. 21) on the piston rod 42.

The piston tube 38 is then removed from the mandrel, and the piston seal 29 is inserted on the front end of the piston. The flange 39 on the piston tube retains the piston on the piston tube even though the springs 60 and 61 are compressed. The compression tube 20 is then inserted over the forward end of the piston.

The compression tube 20, piston 28, piston tube 38, piston rod 42, springs 60 and 61, spring sleeve 62, bushing 121, and locking tool 126 are then inserted as a unit into one of the receiver halves as illustrated in FIG. 28. The forward end of the compression tube 20 butts against a rib 132 on the receiver, and the rear end of the outer spring 61 is positioned slightly forwardly of the flange 68.

After the other components of the gun are inserted into the receiver half, the other half of the receiver is mated with the first half, and the two halves of the receiver are connected by bolts. The flange 68 on each receiver half is provided with a slot 133 (FIG. 29) for accomodating one of the legs 124 of the bushing 121. After the receiver halves are connected, the locking tool 126 is removed from the piston rod 42, and the bushing is slid rearwardly off of the piston rod. The outer spring 61 is retained by the flange 68. The slide 50 can then be mounted on the receiver and secured to the piston rod 42 by the locking ring 54 (FIG. 1).

The gun can be disassembled by following the reverse procedure.

FIGS. 30–34 illustrate a modified embodiment of a spring air gun 135. The gun 135 is similar to the gun 10 and the same reference numerals are used for corresponding parts.

Figure 30:
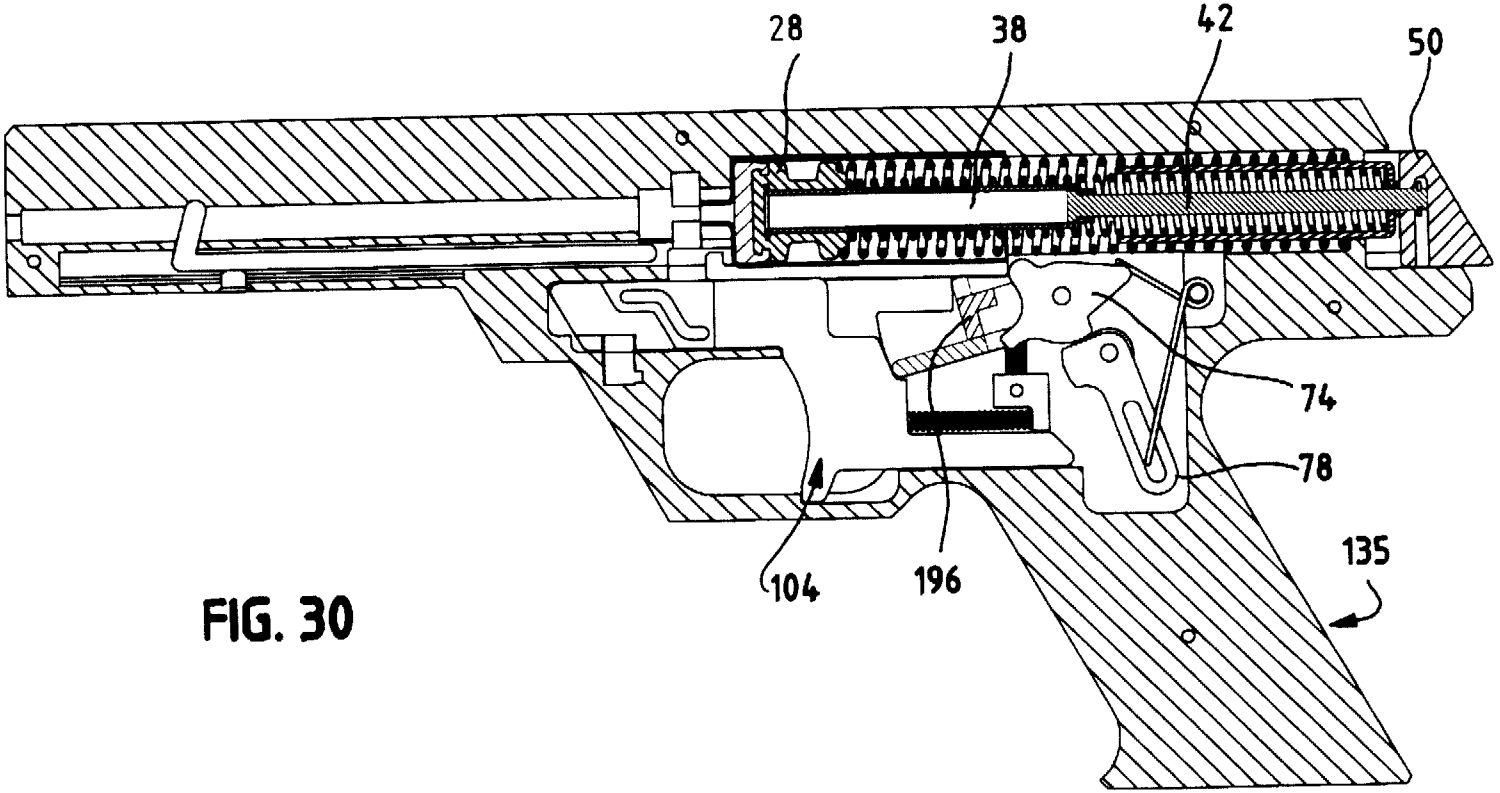
FIG. 30 is a sectional view similar to FIG. 2 of a modified embodiment of a spring air gun.

The gun 135 includes a detent 189 and a detent lever 196 which are pivotally mounted in the frame on the same pin as the sear for generally arcuate movement. In FIG. 30 the detent lever is in its lower position in which it releases the slide 50 and engages the trigger 104 to prevent the trigger from being fired.

Figure 31:
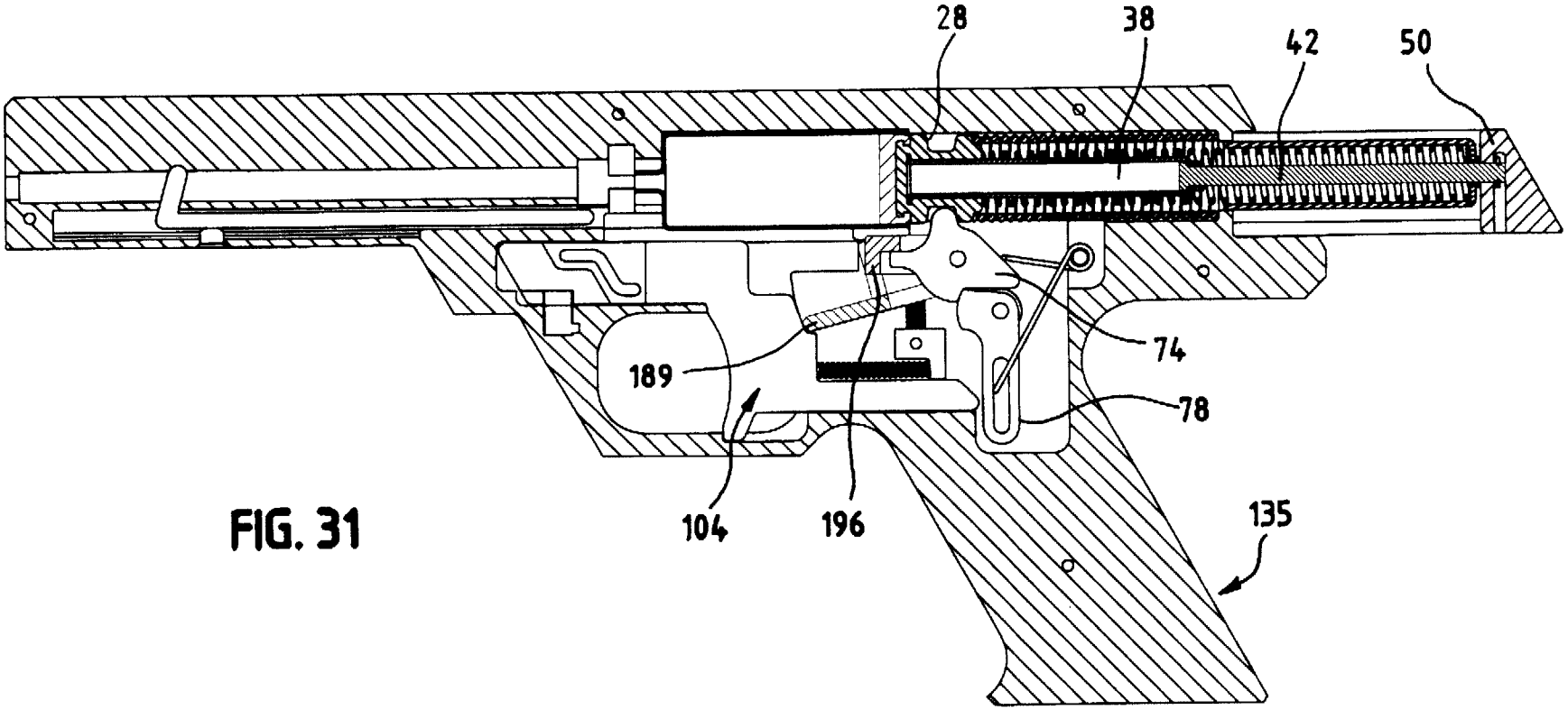
FIG. 31 is a view similar to FIG. 3 showing the gun of FIG. 30.

In FIG. 31 the slide 50 is pulled to the right, and the sear 74 has rotated into engagement with the piston 28. The sear rotates the detent lever 196 upwardly, but the detent 189 remains in blocking position against the trigger 104 so that the trigger cannot be pulled. The detent is prevented from moving out of its blocking position by the bottom walls 58 of the slide 50.

Figure 32:
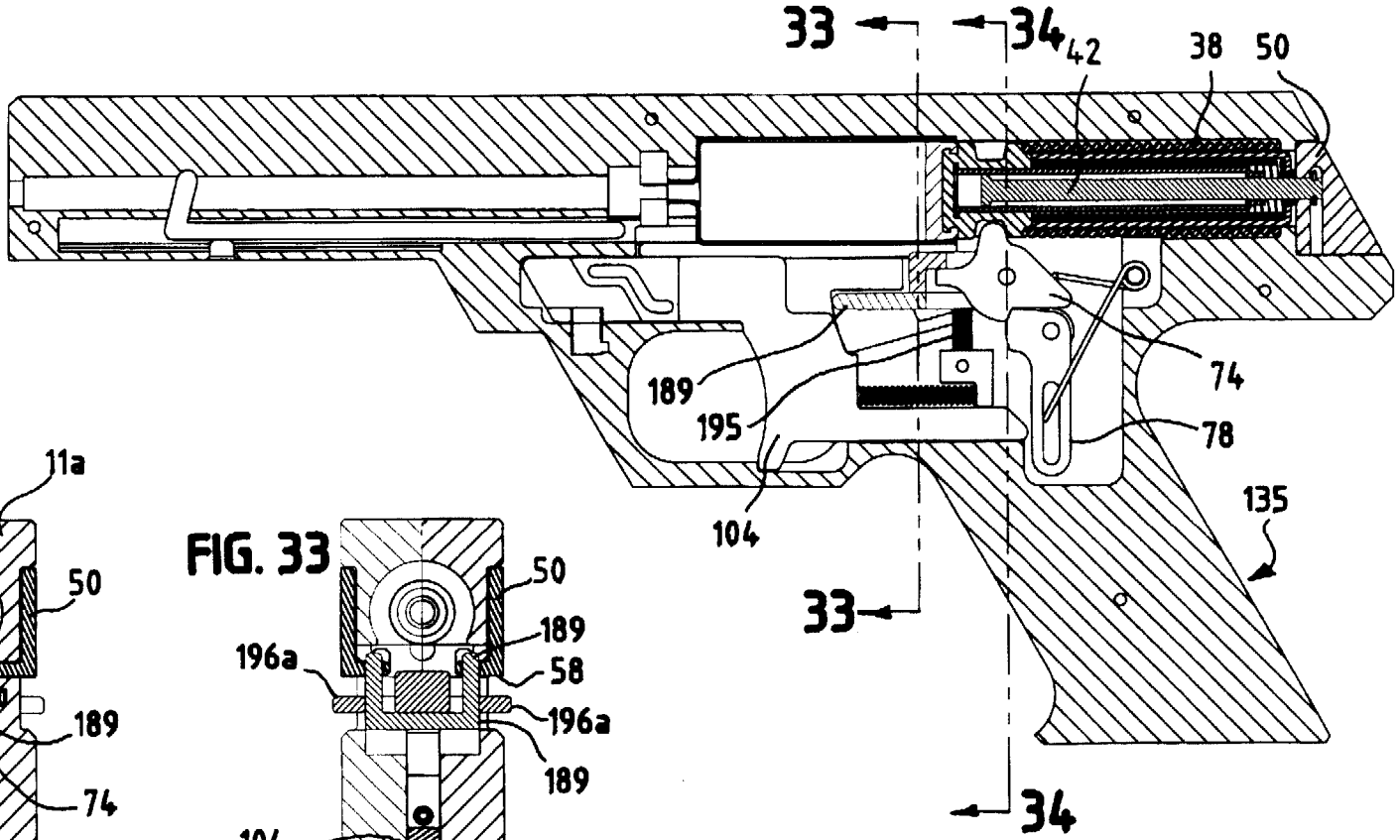
FIG. 32 is a view similar to FIG. 4 showing the gun of FIG. 30.
Figure 33:
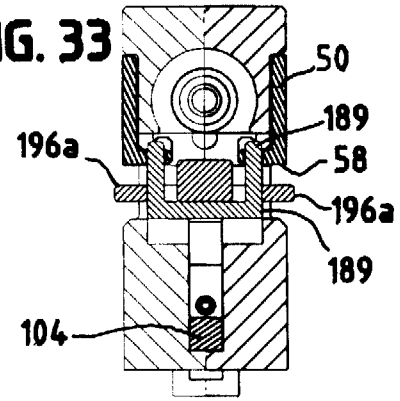
FIG. 33 is a sectional view taken along the line 33—33 of FIG. 32.
Figure 34:
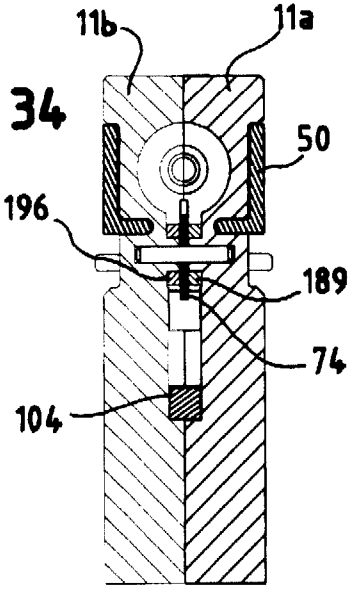
FIG. 34 is a sectional view taken along the line 34—34 of FIG. 32.

In FIG. 32 the slide 50 has been pushed to its forward position, and the gun is cocked and ready to fire. A detent spring 195 pivots the detent 189 upwardly out of engagement with the trigger. Referring to FIG. 33, the detent is allowed to move upwardly when the slide is in the forward position by openings 90 in the bottom walls 58 of the slide 50. Upwardly extending arms 189*a* on the detent are pushed upwardly into the openings by the detent spring 195.

After the gun is fired, the slide 50 is prevented from moving rearwardly by the detent arms 189*a*. The slide is released by pushing the outwardly extending arms 196*a* (FIG. 33) of the detent lever 196 downwardly, which moves the detent to its FIG. 30 position and allows the slide to move to its FIG. 30 position.

FIGS. 35–39 illustrate another embodiment of a spring air gun 210. The gun 210 is similar to the guns 10 and 135 except for the detent and detent lever.

Figure 35:
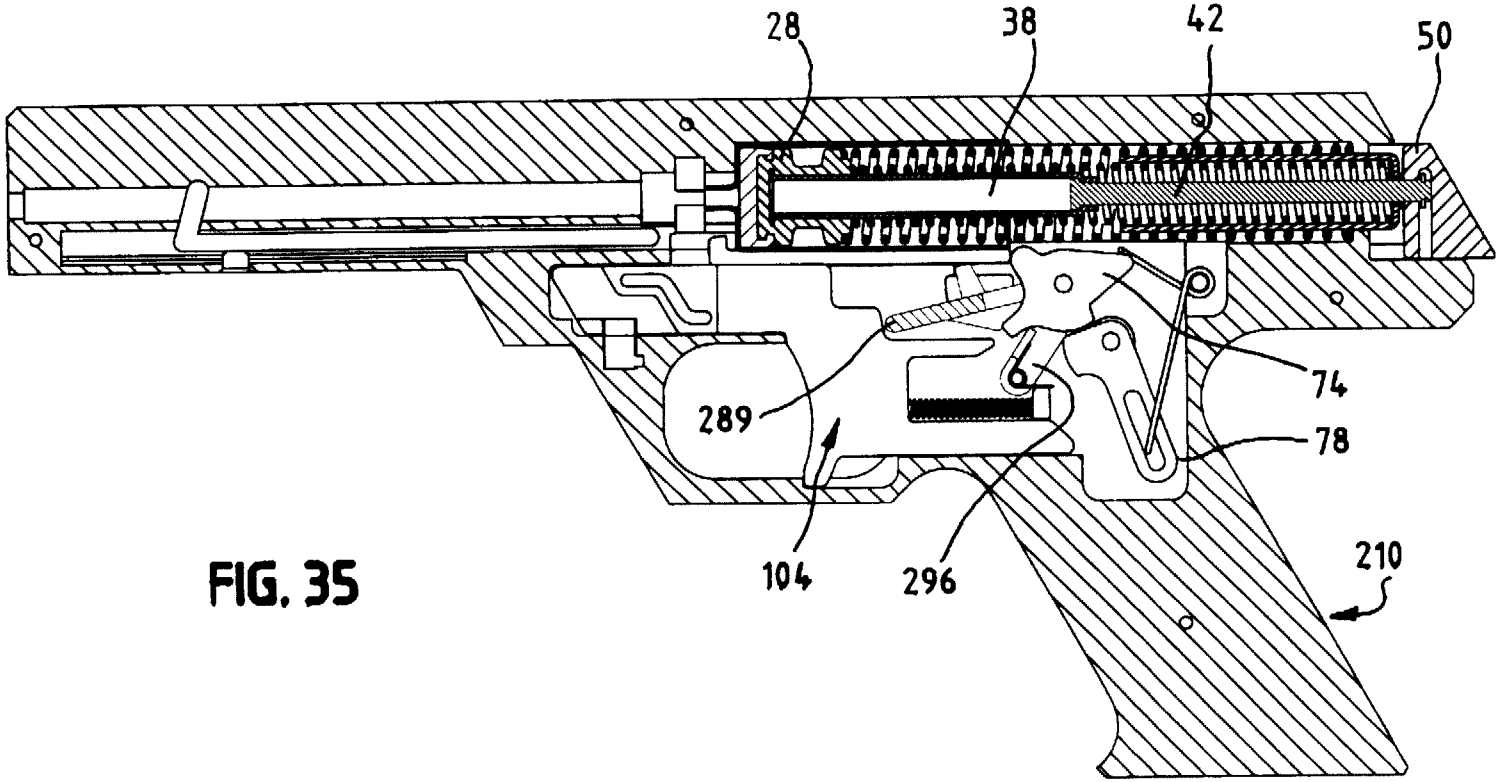
FIG. 35 is a view similar to FIG. 2 showing another embodiment of a spring air gun.

A detent 289 is shown in its lower position in FIG. 35. The slide 50 is released, and the detent engages the trigger 104 and prevents the trigger from being pulled.

Figure 36:
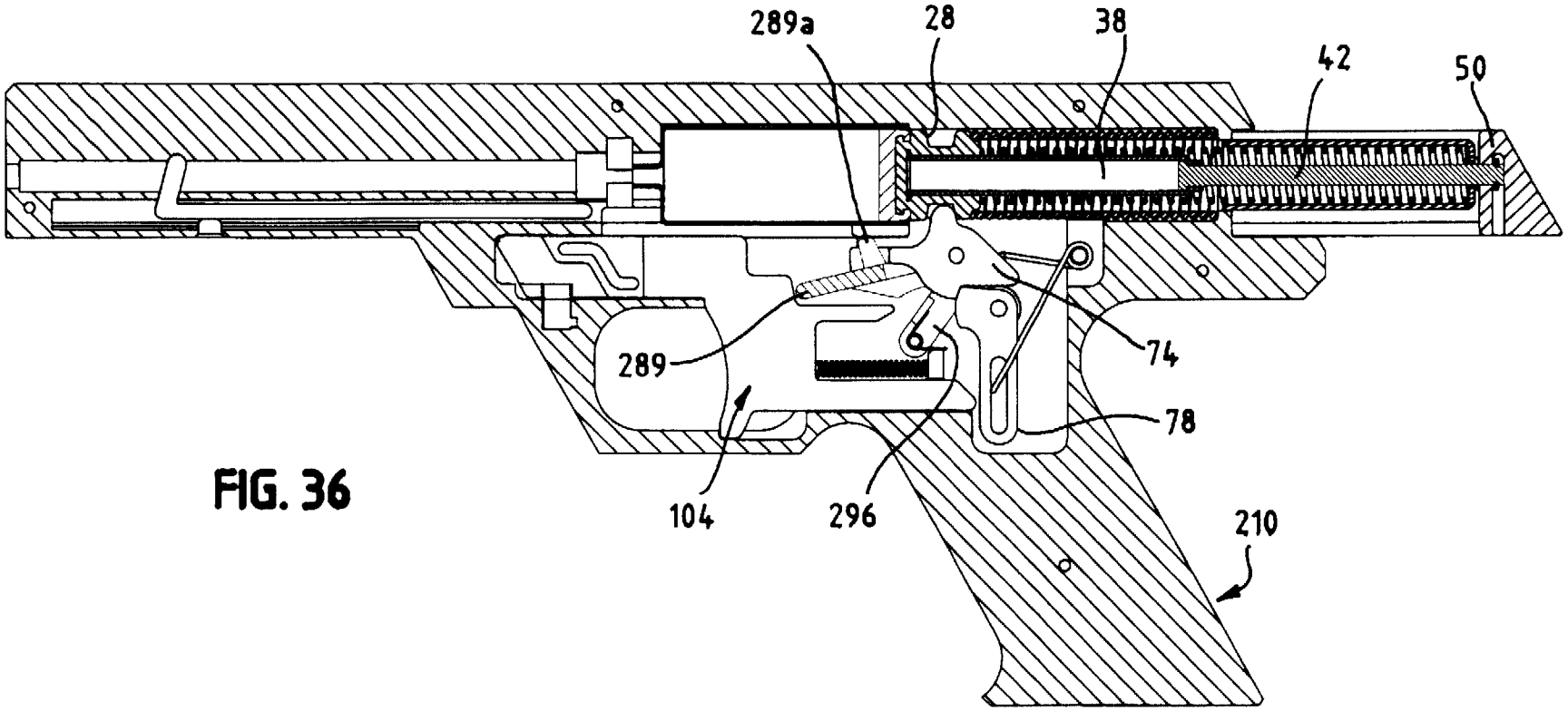
FIG. 36 is a view similar to FIG. 3 showing the gun of FIG. 35.

In FIG. 36, the slide 50 is pulled to the right, and the sear 74 has rotated into engagement with the piston 28. A detent lever 296 is pivotally mounted in the frame below the detent 289 and is biased to rotate counter clockwise against the detent by a spring 295. However, the detent is prevented from moving upwardly by the bottom walls 58 of the slide. The detent includes a pair of upwardly extending arms 289*a* (see also FIG. 38) which abut the bottom walls.

Figure 37:
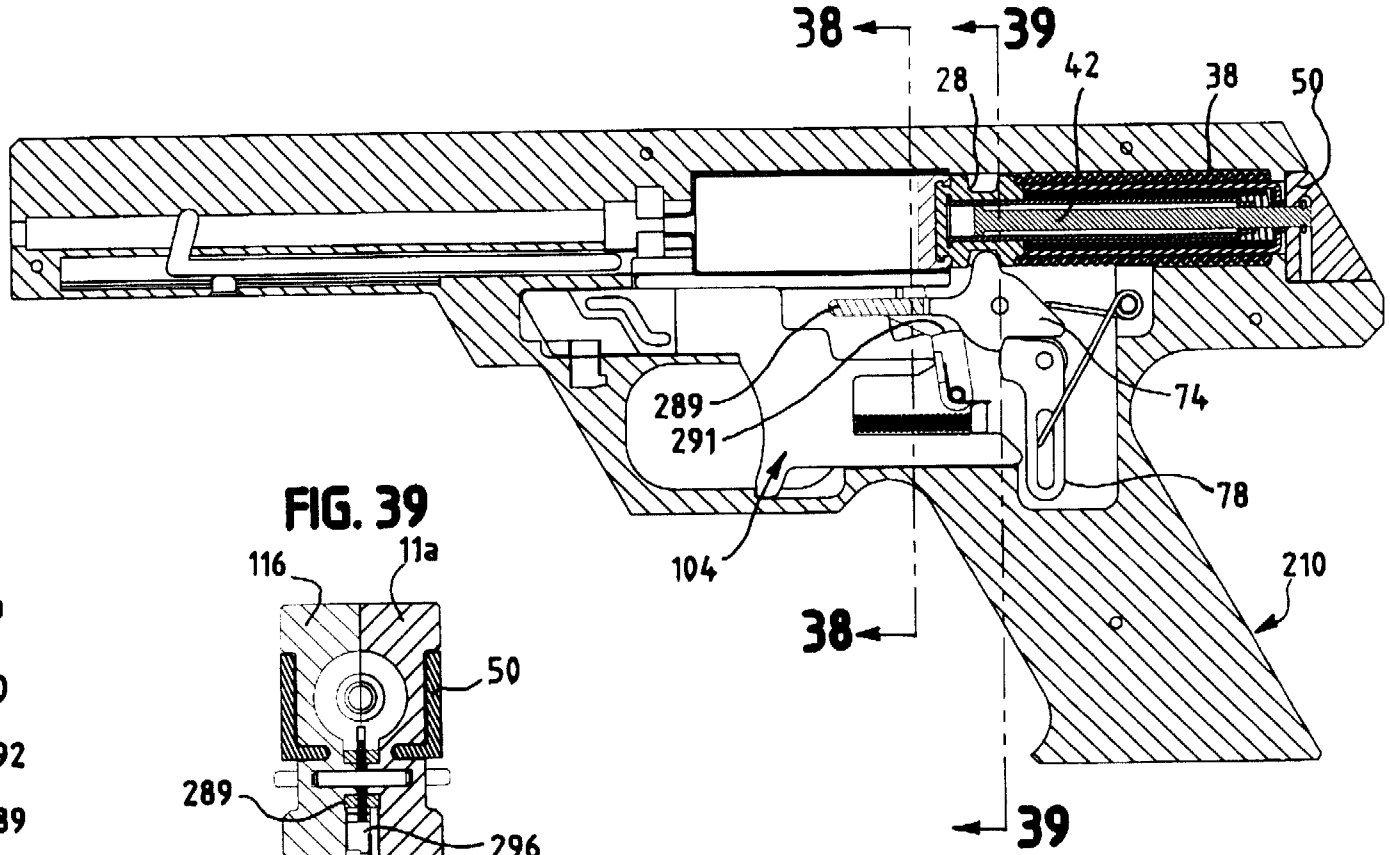
FIG. 37 is a view similar to FIG. 4 showing the gun of FIG. 35.
Figure 39:
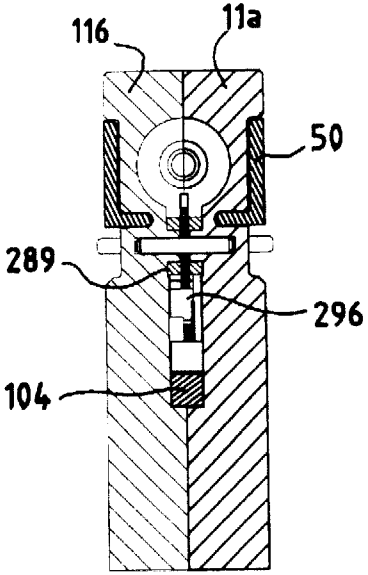
FIG. 39 is a sectional view taken along the line 39—39 of FIG. 37.
Figure 38:
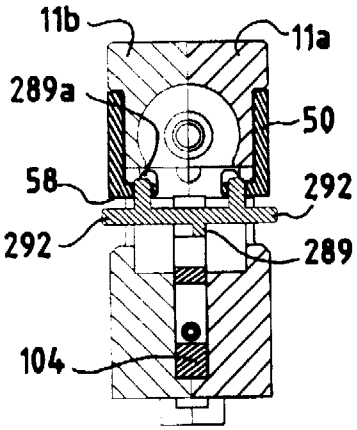
FIG. 38 is a sectional view taken along the line 38—38 of FIG. 37.

In FIG. 37 the slide 50 has been pushed to its forward position, and the gun is cocked and ready to fire. The detent 289 is allowed to pivot upwardly under the force of the detent lever 296 when the openings 90 in the bottom walls 58 of the slide are aligned with the arms 289*a* of the detent. The detent lever engages a curved lower camming surface 291 on the detent.

The detent 289 is prevented from moving downwardly when the gun is cocked and ready to fire by the detent lever 296, which is below the detent.

When the trigger is pulled to fire the gun, a rearwardly extending projection 221 on the trigger engages the detent lever 296 and rotates the lever clockwise. The detent 289 can then be pushed downwardly to release the slide 50. Referring to FIG. 37, the detent includes laterally outwardly extending arms 292 which extend through openings in the frame. The gun can therefore be operated by both right handed and left handed persons.

While in the foregoing specification a detailed description of specific embodiments of the invention was set forth for the purpose of illustration, it will be understood that many of the details herein given can be varied considerably by those skilled in the art without departing from the spirit and scope of the invention.

We claim:

1. A spring air gun comprising:

a frame having front and rear portions, a barrel mounted on the front portion of the frame, a compression cylinder mounted on the frame and communicating with the barrel, a piston slidably mounted in the compression cylinder for movement between a cocked position and a fired position, a sear mounted on the frame for movement between a cocked position in which the sear maintains the piston in the cocked position and a fired position in which the sear allows the piston to move to the fired position, a trigger movably mounted on the frame for movement between an unfired position and a fired position, a first spring engaging the piston for urging the piston toward the fired position, a slide slidably mounted on the frame for movement between forward and rearward positions, means connecting the slide and the piston for moving the piston from the fired position to the cocked position when the slide moves from the forward position to the rearward position, a second spring engaging the piston for urging the slide toward the rearward position, a detent movably mounted on the frame between first and second positions, the detent being engageable with the slide when the detent is in the first position and the slide is in the forward position to prevent the slide from moving rearwardly, the detent being maintained in the second position by the slide when the slide is in the rearward position, the detent preventing the trigger from moving to the fired position when the detent is in the second position.

2. The gun of claim 1 in which the detent is movable in a direction which extends generally perpendicularly to the direction of sliding movement of the slide and includes a first portion which is engageable with the slide and a second portion which is engageable with the trigger when the detent is in the second position.

3. The gun of claim 2 in which the detent is mounted in the frame for pivoting movement, and a detent lever which is formed separately from the detent and which is mounted in the frame for pivoting movement for moving the detent from the second position to the first position when the slide is in the forward position.

4. The gun of claim 3 in which a portion of the detent extends outwardly from the frame whereby the detent can be moved from its first position to its second position when the piston is in the fired position and the slide is in the forward position.

5. The gun of claim 3 in which the trigger includes a projection which is engageable with the detent lever for pivoting the detent lever away from the detent when the trigger moves to the fired position.

6. The gun of claim 1 in which the trigger includes a finger portion and a shoulder, the shoulder being engageable with the detent when the detent is in the second position.

7. The gun of claim 1 in which the slide includes a bottom wall which is provided with a detent opening, the detent extending into the detent opening when the slide is in the forward position.

8. The gun of claim 1 including a detent lever which extends through an opening in the frame for moving the detent from the first position to the second position.

9. The gun of claim 8 in which the detent lever is formed separately from the detent and is movably mounted in the frame.

10. The gun of claim 8 in which the detent lever is engageable with the sear when the sear is in the cocked position whereby the sear prevents the detent lever from moving the detent to the second position.

11. The gun of claim 10 in which the detent lever is formed separately from the detent and is movably mounted in the frame for movement between a first position in which the detent lever does not engage the detent and a second position in which the detent lever maintains the detent in the second position whereby the detent lever can be moved to its first position by the sear when the sear moves to its cocked position while the slide is in the rearward position.

12. The gun of claim 11 in which the sear includes a first shoulder which engages the piston when the piston and the sear are in the cocked positions and a second shoulder which is engageable with the detent lever when the sear is in the cocked position.

13. The gun of claim 11 in which the detent and the detent lever are mounted in the frame for pivoting movement.

14. The gun of claim 1 in which the trigger includes a finger portion and a trigger extension which extends rearwardly from the finger portion, release means movably mounted on the frame for movement between a cocked position for maintaining the sear in the cocked position and a fired position for allowing the sear to move to the fired position, the trigger extension being engageable with the release means as the trigger moves from the unfired position to the fired position for moving the release means to the fired position.

15. The gun of claim 14 in which the slide includes a bottom wall which is provided with a detent opening, the detent extending into the detent opening when the slide is in the forward position.

16. The gun of claim 15 including a detent lever which extends through an opening in the frame for moving the detent from the first position to the second position.

17. The gun of claim 16 in which the detent lever is formed separately from the detent and is movably mounted in the frame.

18. The gun of claim 17 in which the detent lever is engageable with the sear when the sear is in the cocked position whereby the sear prevents the detent lever from moving the detent to the second position.

19. The gun of claim 18 in which the detent lever is formed separately from the detent and is movably mounted in the frame for movement between a first position in which the detent lever does not engage the detent and a second position in which the detent lever maintains the detent in the second position whereby the detent lever can be moved to its first position by the sear when the sear moves to its cocked position while the slide is in the rearward position.

20. A spring air gun comprising:

a frame having front and rear portions, a barrel mounted on the front portion of the frame, a compression cylinder mounted on the frame and communicating with the barrel, a piston slidably mounted in the compression cylinder for movement between a cocked position and a fired position, a sear mounted on the frame for movement between a cocked position in which the sear maintains the piston in the cocked position and a fired position in which the sear allows the piston to move to the fired position, means for moving the sear from the cocked position to the fired position whereby the piston is allowed to move to the fired position, a piston tube extending rearwardly from the piston, a piston rod slidably mounted in the piston tube and extending rearwardly therefrom, a spring sleeve surrounding the piston rod and having a rear wall, a rear end portion of the piston rod extending through an opening in the rear wall of the spring sleeve, an inner spring surrounding the piston tube and the piston rod and being positioned inside of the spring sleeve, the inner spring having a front end engaging the piston and a rear end engaging the rear wall of the spring sleeve, means for preventing rearward movement of the spring sleeve relative to the piston rod, an outer spring surrounding the inner spring and the spring sleeve and having a front end engaging the piston and a rear end, a bushing on the rear end portion of the piston rod, the bushing including forwardly extending projections which engage the rear end of the outer spring and maintain the rear end of the outer spring forwardly of the end wall of the spring sleeve, and means removably mounted on the rear end portion of the piston rod for preventing rearward movement of the bushing relative to the piston rod.

21. The gun of claim 20 in which the means for preventing rearward movement of the spring sleeve comprises a locking ring mounted on the piston rod.

22. The gun of claim 20 in which the means for preventing rearward movement of the bushing comprises a pair of prongs which are inserted into a groove on the end portion of the piston rod.

23. The gun of claim 20 in which the means for preventing rearward movement of the bushing comprises a tool which includes a handle and a pair of prongs which extend from the handle and which are inserted into a groove on the end portion of the piston rod.

* * * * *